US008427068B2

(12) United States Patent
Jang et al.

(10) Patent No.: US 8,427,068 B2
(45) Date of Patent: Apr. 23, 2013

(54) REFERENCE SIGNAL GENERATOR AND PWM CONTROL CIRCUIT FOR LCD BACKLIGHT

(75) Inventors: Yu Jin Jang, Gyunggi-Do (KR); Jeong In Cheon, Seoul (KR)

(73) Assignee: Samsung Electro-Mechanics Co., Ltd. (KR)

( * ) Notice: Subject to any disclaimer, the term of this patent is extended or adjusted under 35 U.S.C. 154(b) by 574 days.

(21) Appl. No.: 12/646,151

(22) Filed: Dec. 23, 2009

(65) Prior Publication Data

US 2011/0062884 A1 Mar. 17, 2011

(30) Foreign Application Priority Data

Sep. 14, 2009 (KR) ..... 10-2009-0086651

(51) Int. Cl.
*H05B 37/02* (2006.01)

(52) U.S. Cl.
USPC ..... 315/291; 323/313; 345/102

(58) Field of Classification Search ..... 315/291, 315/224, 307; 323/311, 312, 313; 327/172, 327/175, 176; 345/102
See application file for complete search history.

(56) References Cited

U.S. PATENT DOCUMENTS

| | | | | |
|---|---|---|---|---|
| 5,481,161 | A * | 1/1996 | El-Hamamsy et al. | 315/224 |
| 6,052,035 | A * | 4/2000 | Nolan et al. | 331/74 |
| 6,107,851 | A * | 8/2000 | Balakirshnan et al. | 327/172 |
| 8,054,060 | B2 * | 11/2011 | Ojanen et al. | 323/351 |
| 2006/0055345 | A1 * | 3/2006 | Takeuchi | 315/291 |
| 2009/0278466 | A1 * | 11/2009 | Wang | 315/219 |

FOREIGN PATENT DOCUMENTS

KR 1020090063558 A 6/2009

* cited by examiner

*Primary Examiner* — Jacob Y Choi
*Assistant Examiner* — Ephrem Alemu
(74) *Attorney, Agent, or Firm* — Lowe Hauptman Ham & Berner, LLP

(57) ABSTRACT

There are provided a reference signal generator and a PWM control circuit for LCD backlight. The reference signal generator and the PWM control circuit for LCD backlight may be configured to respectively include: a current control unit that controls generation of a variable current sequentially changing; a current generating unit that generates a variable current changing sequentially; and a reference signal generating unit that controls charging until a charged voltage charged by the variable current generated by the current generating unit reaches a first reference voltage level, starts discharging when the charged voltage reaches the first reference voltage level, controls discharging until the charged voltage reaches a second reference voltage level, and generates a triangular wave reference signal that has a frequency buffering interval in which a frequency sequentially changes when the initial driving completion signal or the protection signal is input.

14 Claims, 5 Drawing Sheets

REFERENCE SIGNAL GENERATOR AND PWM CONTROL CIRCUIT FOR LCD BACKLIGHT

CROSS-REFERENCE TO RELATED APPLICATIONS

This application claims the priority of Korean Patent Application No. 10-2009-0086651 filed on Sep. 14, 2009, in the Korean Intellectual Property Office, the disclosure of which is incorporated herein by reference.

BACKGROUND OF THE INVENTION

1. Field of the Invention

The present invention relates to a reference signal generator that can be used in an LCD backlight inverter and a PWM control circuit for LCD backlight, and more particularly, to a reference signal generator and a PWM control circuit capable of changing the frequency of a reference signal in a soft manner by inserting a frequency buffering interval when there is a change in the driving mode such as a change from initial driving to normal driving or a change from normal driving to protection driving.

2. Description of the Related Art

Generally, backlight inverters used in LCD (Liquid Crystal Display) TV sets or LCD monitors to which CCFLs (Cold Cathode Fluorescent Lamps) are applied include various protection circuits for protecting internal components.

In order to improve the quality of TV sets and monitors that have recently been developed, greater precision is require in the design of protection circuits. For example, in order to drive the CCFL (hereinafter referred to as a lamp) in the initial period, the protection circuit performs a function for lighting the lamp intensively at a high frequency that is higher than a normal frequency and lowering the frequency to the normal frequency at the time when the lamp is stabilized after an elapsed period of time.

In addition, when there is a problem in the operation of the lamp, the protection circuit performs a function of protecting an open part of the lamp and a transformer by operating the lamp at a higher frequency than that of normal operations.

However, in such a driving method, controlling a time interval for the lamp's higher frequency output in accordance with the lamp's specifications of the lamp and a driving current in the initial period may be demanding. In addition, there is a problem that internal components such as a lamp and a transformer may be damaged when an abrupt change from a high frequency to a low frequency or from a low frequency to a high frequency is made.

SUMMARY OF THE INVENTION

An aspect of the present invention provides a reference signal generator and a PWM control circuit for an LCD backlight capable of changing the frequency of a reference signal in a soft manner by inserting a frequency buffering interval at such time as a change in a driving mode, such as a change from initial driving to normal driving or a change from the normal driving to protection driving, is made and suppressing the occurrence of peaking by decreasing an abrupt change in the driving frequency.

According to a first aspect of the present invention, there is provided a reference signal generator including: a variable resistance unit that provides variable resistance changing sequentially in accordance with a load control signal acquired by calculating a logical sum of an initial driving completion signal and a protection signal for soft frequency changing; a current control unit that controls the generation of a variable current sequentially changing in accordance with the variable resistance that is provided by the variable resistance unit; a current generating unit that generates a variable current sequentially changing based on the control of the generation of the variable current that is performed by the current control unit; and a reference signal generating unit that controls charging until a charged voltage charged by the variable current generated by the current generating unit reaches a first reference voltage level, starts discharging when the charged voltage reaches the first reference voltage level, controls discharging until the charged voltage reaches a second reference voltage level, and generates a triangular wave reference signal that has a frequency buffering interval in which a frequency changes sequentially when the initial driving completion signal or the protection signal is input.

In addition, according to a second aspect of the present invention, there is provided a PWM control circuit for an LCD backlight including: a variable resistance unit that provides variable resistance changing sequentially in accordance with a load control signal acquired by calculating a logical sum of an initial driving completion signal and a protection signal for soft frequency changing; a current control unit that controls generation of a variable current changing sequentially in accordance with the variable resistance that is provided by the variable resistance unit; a current generating unit that generates a variable current changing sequentially based on the control of the generation of the variable current that is performed by the current control unit; a reference signal generating unit that controls charging until a charged voltage charged by the variable current generated by the current generating unit reaches a first reference voltage level, starts discharging when the charged voltage reaches the first reference voltage level, controls discharging until the charged voltage reaches a second reference voltage level, and generates a triangular wave reference signal that has a frequency buffering interval in which a frequency changes sequentially when the initial driving completion signal or the protection signal is input; and a PWM control unit that includes an inverted input terminal receiving a reference signal from the reference signal generating unit as an input and two non-inverted input terminals receiving an error amplifier voltage and a soft start voltage and outputs a pulse-width modulated signal by comparing the reference signal, the error amplifier voltage, and the soft start voltage.

In the first and second aspects of the present invention, the variable resistance unit may be configured to provide variable resistance changing sequentially for soft frequency changing that decreases the frequency from a high initial driving frequency to a low normal driving frequency in a case where the load control signal is the initial low level driving completion signal.

In addition, the variable resistance unit may be configured to provide variable resistance changing sequentially for soft frequency changing that gradually increases the frequency from the low normal driving frequency to a high protection driving frequency in a case where the load control signal is the high level protection signal.

In addition, the variable resistance unit may be configured to include: a first resistor having one end connected to a first power source voltage terminal and the other end; a first diode having a cathode connected to the other end of the first resistor and an anode; a second resistor having one end connected to the anode of the first diode and the other end; a third resistor that is connected between the other end of the second resistor and the ground; a fourth resistor having one end connected to a first connection node between the first resistor and the first diode and the other end; a first capacitor that is connected between the other end of the fourth resistor and the ground; and a variable voltage switch that is connected to the first capacitor in parallel, is turned on when the load control signal is of the high level, and is turned off when the load control signal is of the low level.

In addition, the current control unit may be configured to control the generation of a variable current that sequentially decreases in accordance with a variable current flowing through a detection node between the second resistor and the third resistor in a case where the load control signal is the initial driving completion signal.

In addition, the current control unit may be configured to control the generation of a variable current that sequentially increases in accordance with the variable current flowing through the detection node between the second resistor and the third resistor in a case where the load control signal is also the protection signal.

In addition, the current generating unit may be configured to include: a first current source that is connected to a second power source voltage terminal and variably generates a charging current based on the control of the variable current generation performed by the current control unit; and a second current source that is connected between the first current source and the ground in series and variably generates a discharging current based on the control of the variable current generation performed by the current control unit.

In addition, the second current source may be configured to generate a current that is higher than a current generated by the first current source, for example, twice as high as the current generated by the first current source.

In addition, the reference signal generating unit may be configured to include: a charging capacitor that is connected between the first current source and the ground and charges the current that is generated by the first current source; a charging and discharging switch that is connected between a connection node between the first current source and the charging capacitor and the second current source, turned on or off in accordance with a switching control signal for generating a reference signal of a triangular wave, is turned off for charging the charging capacitor, and is turned on for discharging the charging capacitor; a first comparator that compares a charged voltage charged in the capacitor by the variable current that is generated by the current generating unit with the first reference voltage and outputs the high level in a case where the charged voltage is higher than the first reference voltage; a second comparator that compares the charged voltage of the capacitor with the second reference voltage and outputs the high level in a case where the charged voltage is lower than the second reference voltage; and a latch unit that is reset in accordance with the high level output from the first comparator, is set in accordance with the high level output from the second comparator, outputs a switching control signal for discharging control when being reset, and outputs a switching control signal for charging control when being set.

According to an embodiment of the present invention, the frequency of a reference signal can be changed in a soft manner by inserting a frequency buffering interval at the time when a change in a driving mode such as a change from initial driving to normal driving or a change from the normal driving to protection driving is made, and occurrence of peaking can be suppressed by decreasing an abrupt change in the driving frequency. Therefore, there is an advantage that internal components can be protected.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
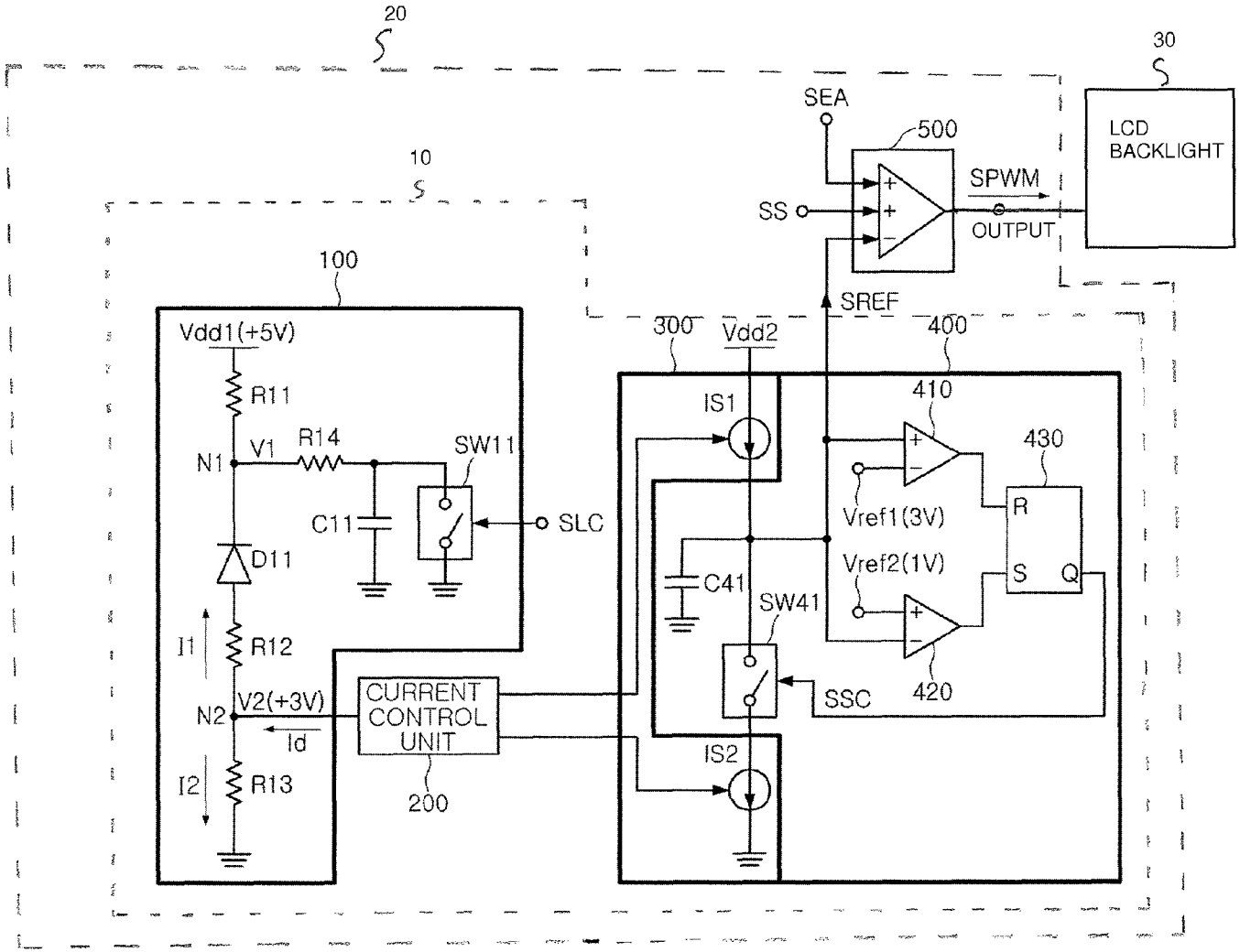
FIG. 1 is a block diagram of a reference signal generator and a PWM control circuit for an LCD backlight according to an embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

FIG. 1 is a block diagram of a reference signal generator 10 and a PWM control circuit for LCD backlight 20 according to an embodiment of the present invention. As shown in FIG. 1, the reference signal generator 10 according to an embodiment of the present invention may be configured to include: a variable resistance unit 100 and, a current control unit 200, a current generating unit 300, and a reference signal generating unit 400. The variable resistance unit 100 provides variable resistance changing sequentially in accordance with a load control signal SLC, which is acquired by a logical OR operation of an initial driving completion signal and a protection signal, for soft frequency changing. The current control unit 200 controls a current flowing through the variable resistance unit 100 and a current flowing through the current generating unit 300 in accordance with the variable resistance provided by the variable resistance unit 100. The current control unit 200 is configured to detect a current Id and to apply a variable voltage V2 to the variable resistance unit 100 in accordance with the detect current Id to control the current flowing through the variable resistance unit 100. The current generating unit 300 generates a variable current changing sequentially in accordance with the control performed by the current control unit 200. The reference signal generating unit 400 controls charging until a voltage charged by the variable current generated by the current generating unit 300 reaches a first reference voltage level Vref1, starts discharging when the charged voltage reaches the first reference voltage level Vref1, controls discharging until the charged voltage reaches a second reference voltage level Vref2, and generates a triangular wave reference signal having a frequency buffering interval in which the frequency sequentially changes when the initial driving completion signal or the protection signal is input.

In addition, the PWM control circuit for an LCD backlight according to an embodiment of the invention may be configured to include the above-described reference signal generator 10 and a PWM control unit 500 that includes an inverted input terminal receiving a reference signal SREF from the reference signal generating unit 400 as an input and two non-inverted input terminals receiving an error amplifier voltage SEA and a soft start voltage SS as inputs and outputting a pulse-width modulated (PWM) signal by comparing the reference signal SREF, the error amplifier voltage SEA, and the soft start voltage SS.

The variable resistance unit 100 is configured to provide variable resistance that sequentially changes for soft frequency changing that gradually decreases the frequency from a high initial driving frequency to a low normal driving frequency in a case where the load control signal SLC is the initial driving completion signal of a low level. Here, a soft start interval (T1 shown in FIG. 5) is for initial driving, and the initial driving completion signal represents a point in time at which the soft start interval T1 ends.

In addition, the variable resistance unit 100 is configured to provide variable resistance that changes sequentially for soft frequency changing that gradually increases the frequency from a low normal driving frequency to a high protection driving frequency in a case where the load control signal SLC is a high level protection signal. Here, the protection signal represents a signal that is used for protecting an internal element in a case where a problem such as an open lamp occurs.

As an example of implementation, the variable resistance unit 100 may be configured to include: a first resistor R11 having one end connected to a first power source voltage Vdd1 terminal and the other end; a first diode D11 having a cathode connected to the other end of the first resistor R11 and an anode; a second resistor R12 having one end connected to the anode of the first diode D11 and the other end; a third resistor R13 that is connected between the other end of the second resistor R12 and the ground; a fourth resistor R14 having one end connected to a first connection node N1 between the first resistor R11 and the first diode D11; a first capacitor C11 that is connected between the other end of the fourth resistor R14 and the ground; and a voltage variable switch SW11 that is connected in parallel to the first capacitor C11, is turned on in a case where the load control signal SLC is of the high level, and is turned off in a case where the load control signal SLC is of the low level.

The current control unit 200 is configured so as to control the generation of a variable current that sequentially decreases in accordance with a variable voltage applied to a detection node N2 between the second resistor R12 and the third resistor R13 in a case where the load control signal SLC is the initial driving completion signal.

On the other hand, the current control unit 200 is configured so as to control the generation of a variable current that sequentially increases in accordance with a variable voltage applied to the detection node N2 between the second resistor R12 and the third resistor R13 in a case where the load control signal SLC is the protection signal.

Figure 2:
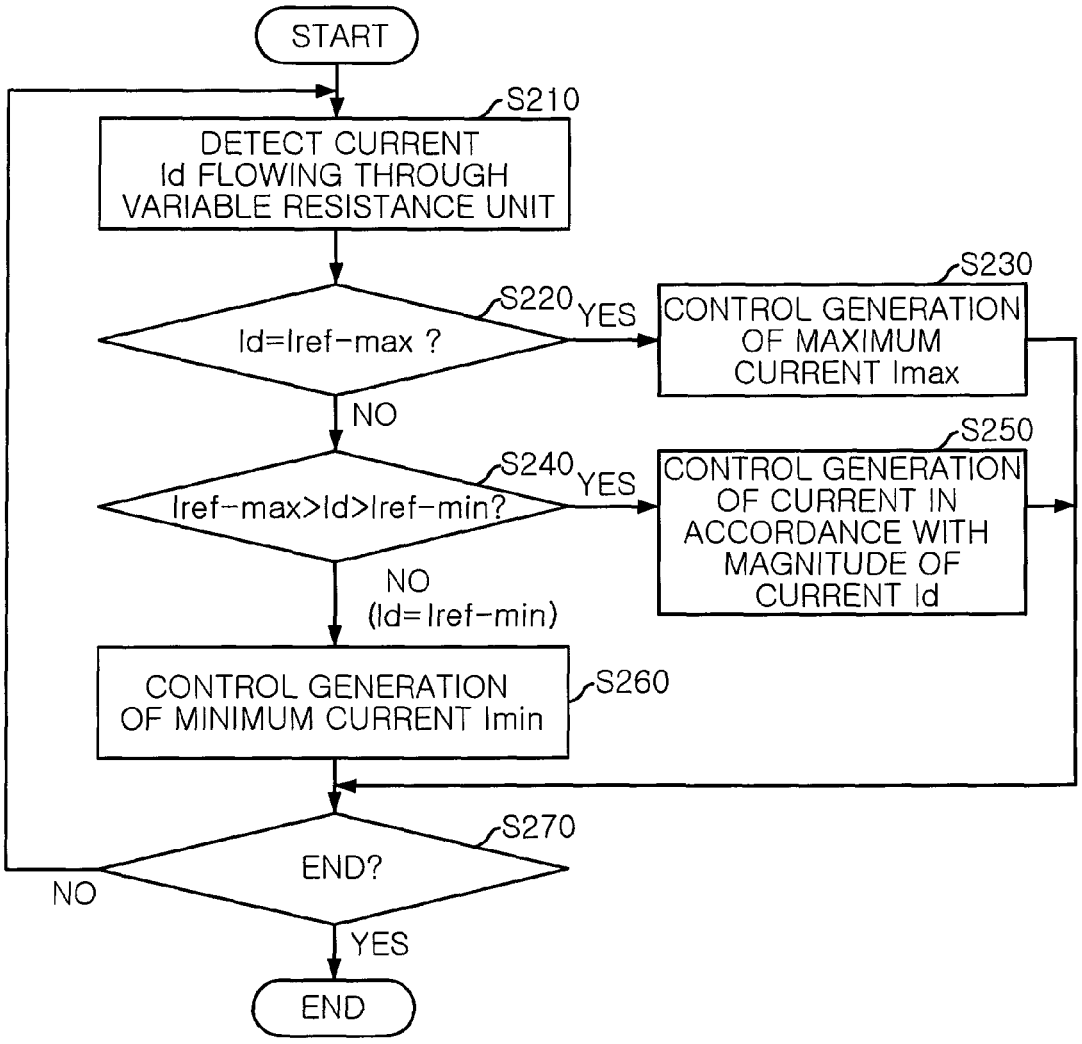
FIG. 2 is a flowchart representing the operation of a current control unit according to an embodiment of the present invention.

FIG. 2 is a flowchart representing the operation of the current control unit according to an embodiment of the present invention. A current flowing through the variable resistance unit 100 can be changed by the current control unit 200 in accordance with a change in the resistance of the variable resistance unit 100. As shown in FIG. 2, the current control unit 200 detects such a current Id in operation 5210. Then, the current control unit 200 is configured to control the generation of a maximum current Imax in a case there the detection current Id is equal to a maximum reference current Iref-max set in advance in operations 5220 and 5230, to control the generation of a current in accordance with the magnitude of the detection current Id in a case where the detection current Id is lower than the maximum reference current Iref-max set in advance and higher than a minimum current Iref-min set in advance in operations 5240 and 5250, and to control generation of a minimum current Imin in a case where the detection current Id is equal to the minimum current Iref-min.

The current generating unit 300 may be configured to include: a first current source IS1 that is connected to a second power source voltage Vdd2 terminal and variably generates a charging current based on the control of generation of a variable current that is performed by the current control unit 200; and a second current source IS2 that is connected in series between the first current source IS1 and the ground and variably generates a discharging current based on the control of the generation of a variable current that is performed by the current control unit 200.

In such a case, in order to set a discharging time to be shorter than a charging time, the second current source IS2 is set so as to generate a current that is higher than that generated by the first current source IS1.

As an example of implementation, the second current source IS2 may be configured so as to generate a current twice as high as the current generated by the first current source IS1.

Figure 3:
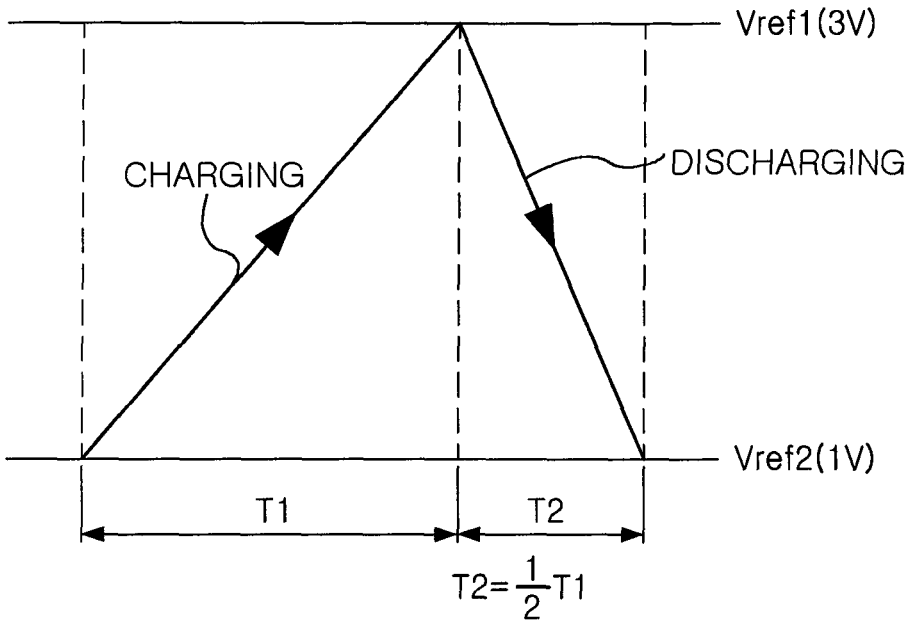
FIG. 3 is a waveform diagram of reference signals on the basis of the current generation of a current generating unit according to an embodiment of the present invention.

FIG. 3 is a waveform diagram of reference signals on the basis of the current generating unit's current generation according to an embodiment of the present invention. As shown in FIG. 3, the current generated by the second current source IS2 is twice as high as the current generated by the first current source IS1. Thus, assuming that a charging time on the basis of the current generated by the first current source IS1 is "T1", a discharging time T2 on the basis of the current generated by the second current source IS2 is a half of the charging time "T1"

$$\left(T2 = \frac{1}{2}T1\right).$$

In addition, the reference signal generating unit 400 may be configured to include: a charging capacitor C41 that is connected between the first current source IS1 and the ground and charges the current generated by the first current source IS1; a charging and discharging switch SW41 that is connected between a connection node between the first current source IS1 and the charging capacitor C41 and the second current source IS2, is turned on or off in accordance with a switching control signal SSC for generating a triangular wave reference signal, is turned off for charging the charging capacitor C41, and is turned on for discharging the charging capacitor C41; a first comparator 410 that compares the charging voltage charged in the capacitor in accordance with the variable current generated by the current generating unit 300 with the first reference voltage Vref1 and outputs a high level in a case where the charging voltage is higher than the first reference voltage Vref1; a second comparator 420 that compares the charging voltage charged in the capacitor with the second reference voltage Vref2 and outputs a high level in a case where the charging voltage is lower than the second reference voltage Vref2; and a latch unit 430 that is reset in accordance with the high level output from the first comparator 410, is set in accordance with the high level output from the second comparator 420, outputs a switching control signal SSC for discharging control at the time of being reset, and outputs a switching control signal SSC for charging control at the time of being set.

Figure 4:
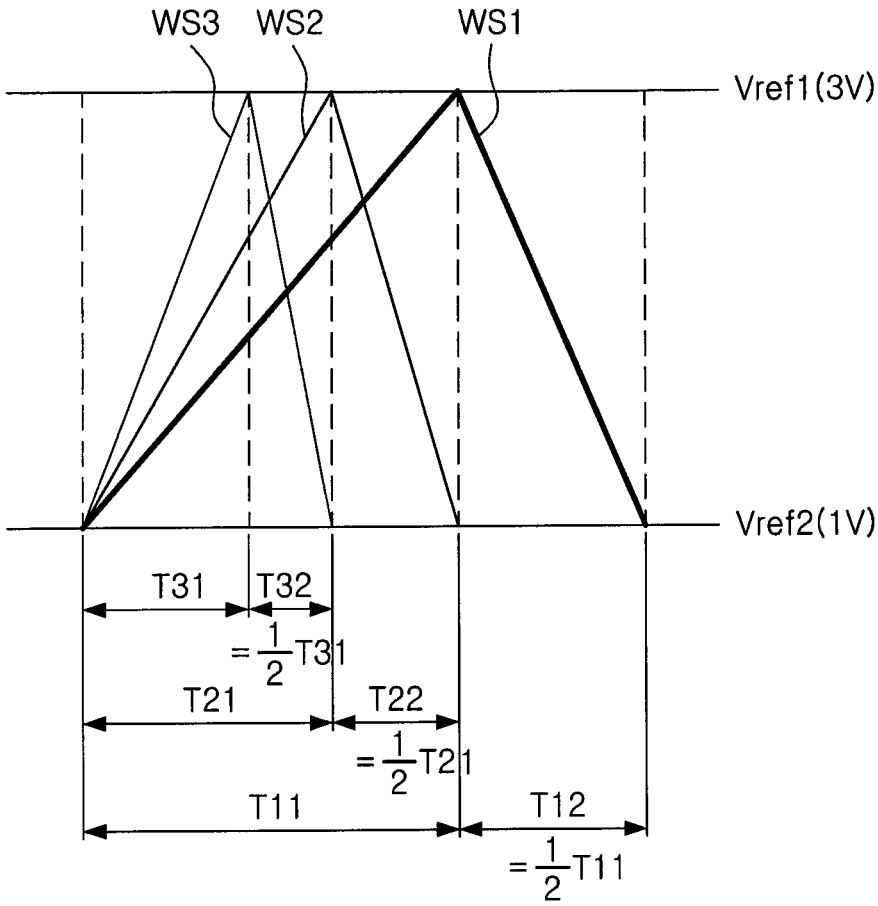
FIG. 4 is a diagram illustrating the changing of frequencies of reference signals that is performed by a current control unit and a current generating unit according to an embodiment of the present invention.

FIG. 4 is a diagram illustrating the changing of frequencies of the reference signals that is performed by the current control unit and the current generating unit according to an embodiment of the present invention. In each of WS1, WS2 and WS3 shown in FIG. 4, a discharging time (T12, T22, and T32) is a half of a charging time (T11, T21, and T31). In the figure, WS1 is a triangular wave having the lowest frequency, WS2 is a triangular wave having a middle frequency, and WS3 is a triangular wave having the highest frequency. For example, WS1 may correspond to a triangular wave of a reference signal at the time of normal driving (T3 shown in FIG. 5), WS2 may correspond to a triangular wave of a reference signal during the first and second buffering intervals (T2 and T4 shown in FIG. 5), and WS3 may correspond to a triangular wave of a reference signal at the time of initial driving (T1 shown in FIG. 5) or at the time of protection driving (T5 shown in FIG. 5).

Figure 5:
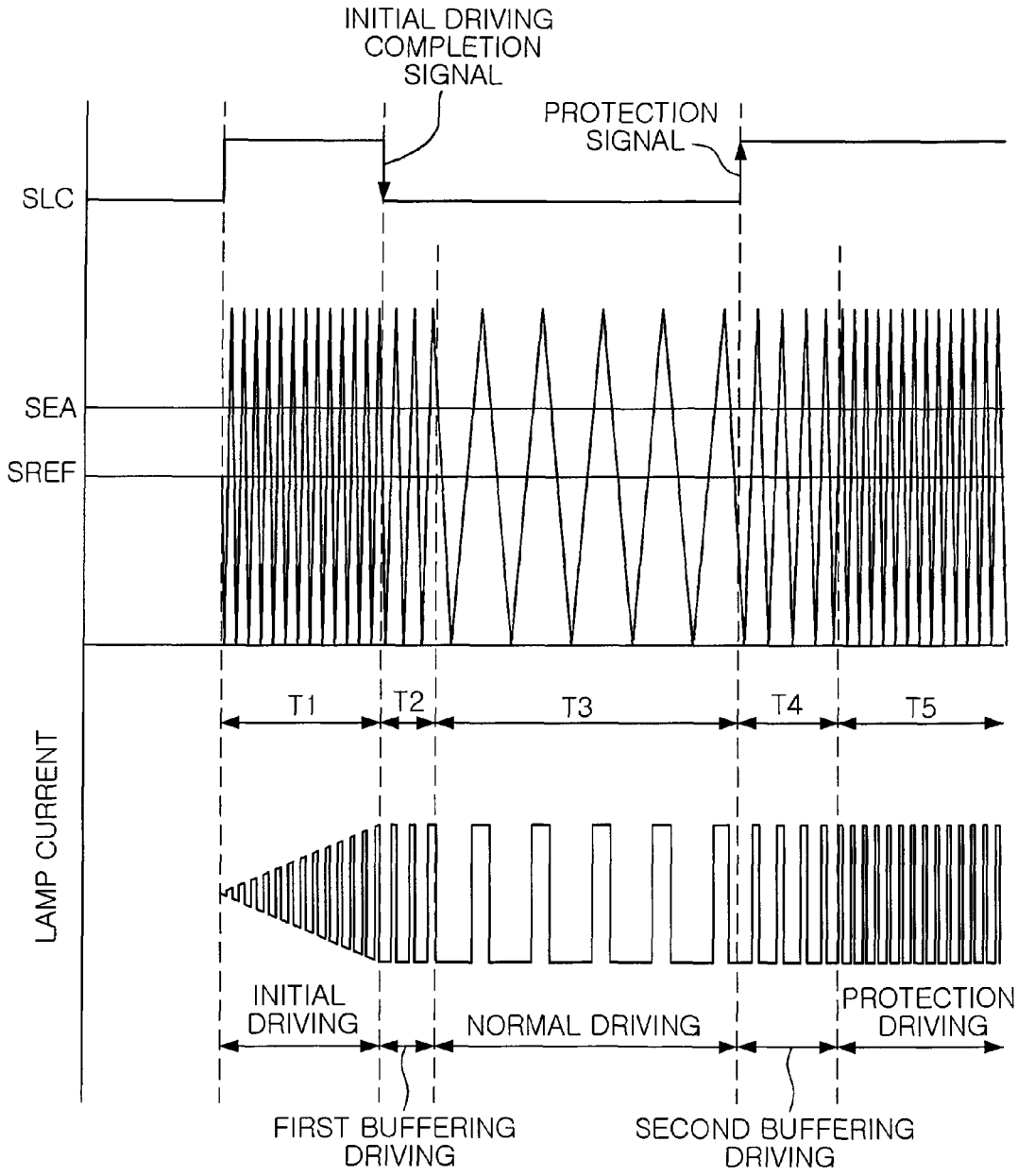
FIG. 5 is a timing chart of major signals in an embodiment of the present invention.

FIG. 5 is a timing chart for major signals in an embodiment of the present invention. In FIG. 5, SLC is a load control signal that is generated by calculating a logical sum of the initial driving completion signal and the protection signal. The initial driving completion signal is a signal having the low level that is changed from the high level set during the initial driving interval T1. In addition, the protection signal is a signal having the high level that is changed from the low level set during the normal driving interval T3.

In addition, SREF is a reference signal for a triangular wave having different frequencies in the initial driving interval T1, the first buffering interval T2, the normal driving interval T3, the second buffering interval T4, and the normal driving interval T5.

A lamp current corresponds to a current flowing through a lamp in accordance with a PWM control signal in each of the initial driving interval T1, the first buffering interval T2, the normal driving interval T3, the second buffering interval T4, and the normal driving interval T5 of the reference signal.

Hereinafter, the operations and advantages of an embodiment of the present invention will be described in detail with reference to the accompanying drawings.

Hereinafter, the reference signal generator 10 and the PWM control circuit for LCD backlight 20 according to an embodiment of the present invention will be described with reference to FIGS. 1 to 5. In FIG. 1, the PWM control circuit for an LCD back light according to the embodiment of the present invention may be configured to include a reference signal generator 10 and a PWM control unit 500.

As shown in FIG. 1, the variable resistance unit 100 of the reference signal generator 10 according to the embodiment of the present invention provides variable resistance changing sequentially in accordance with a load control signal SLC, which is acquired by calculating a logical sum of an initial driving completion signal and a protection signal, for soft frequency changing.

Here, when the resistance provided by the variable resistance unit 100 changes, a current flowing through a resistor of the variable resistance unit 100 also changes.

When the current flowing through the variable resistor provided by the variable resistance unit 100 is changed, a current control unit 200 according to an embodiment of the present invention sequentially changes current generation in the current generating unit 300 in accordance with a change in the current flowing through the variable resistance unit 100.

For example, when the resistance of the variable resistance unit 100 gradually increases, the current control unit 200 detects the current gradually decreasing due to resistance and controls the current generating unit 300 to decrease current generation. On the contrary, when the resistance of the variable resistance unit 100 gradually decreases, the current control unit 200 detects the current gradually increasing due to resistance and controls the current generating unit 300 to increase current generation.

Next, the current generating unit 300 generates a variable current that sequentially changes based on the control of the generation of the variable current that is performed by the current control unit 200.

In other words, the current generating unit 300 increases the current for high-speed charging and discharging or decreases the current for low-speed charging or discharging based on the control of the current control unit 200.

Then, the reference signal generating unit 400 controls charging until a voltage charged by the variable current generated by the current generating unit 300 reaches a first reference voltage Vref1, starts discharging when the charged voltage reaches the first reference voltage Vref1, controls discharging until the charged voltage reaches a second reference voltage Vref2, and generates a triangular wave reference signal having a frequency buffering interval in which the frequency changes sequentially when the initial driving completion signal or the protection signal is input.

Described in greater detail, the charging capacitor C41 of the reference signal generating unit 400 charges the current of the first current source IS1 when the charging and discharging switch SW41 is turned off. Then, the first comparator 410 compares the charged voltage, which is charged in the capacitor by the variable current generated by the current generating unit 300, with the first reference voltage Vref1. When the charged voltage is higher than the first reference voltage Vref1, the first comparator 410 outputs the high level to a reset terminal of the latch unit 430. At this moment, the latch unit 430 turns off the charging and discharging switch SW41 so as to discharge the voltage charged in the charging capacitor C41.

Subsequently, while discharging in the charging capacitor C41 continues, the second comparator 420 compares the charged voltage of the capacitor with the second reference voltage Vref2. When the charged voltage is lower than the second reference voltage Vref2, the second comparator 420 outputs the high level to the set terminal of the latch unit 430. At this moment, the latch unit 430 turns on the charging and discharging switch SW41 so as to control charging in the charging capacitor C41.

Through the charging and discharging operations described above, as illustrated in FIG. 4, a triangular wave reference signal SREF is generated. In such a case, as the charging and discharging times decrease, the frequency of the reference signal increases (WS1→WS2→WS3 illustrated in FIG. 4). On the other hand, as the charging and discharging times increase, the frequency of the reference signal decreases (WS3→WS2→WS1 illustrated in FIG. 4).

In addition, when the PWM control circuit for an LCD backlight according to an embodiment of the invention is configured to include the PWM control unit 500, the PWM control unit 500 includes an inverted input terminal receiving a reference signal SREF from the reference signal generating unit 400 as an input and two non-inverted input terminals receiving an error amplifier voltage SEA and a soft start voltage SS as inputs. The PWM control unit 500 compares the lower amount of the error amplifier voltage SEA and the soft start voltage SS, which are input into the non-inverted input terminals, and outputs a pulse-width modulated (PWM) signal having a pulse width corresponding to the result of the comparison to a LCD backlight 30.

As described above, the charging time and the discharging time are controlled through the current control performed by the current control unit 200, whereby the frequency of the reference signal is controlled. Hereinafter, the operations according to an embodiment of the present invention will be described in greater detail for each driving interval for the case where the first power source voltage Vdd1 is 5 V, and a voltage V2 of the detection node N2 of the variable resistance unit 100 is set to 3 V.

First, in the initial driving interval (interval T1 shown in FIG. 5) shown in FIG. 5, when the load control signal SLC is a high-level signal, the voltage variable switch SW11 of the variable resistance unit 100 is turned on, and the first connection node N1 between the first resistor R1 and the first diode D11 is grounded through the voltage variable switch SW11. Accordingly, the first diode D11 is turned on, and a first current I1 flows in the current control unit 200 through the fourth resistor R14 and the voltage variable switch SW11, and simultaneously, a second current I2 flows through the third resistor R13. At this moment, a detection current Id corresponding to a sum current of the first current I1 and the second current I2 is the maximum current. Accordingly, the current control unit 200 controls the generation of the maximum current Imax.

Next, when the load control signal SLC is a low-level signal in accordance with the initial driving completion signal (interval T2 shown in FIG. 5) shown in FIG. 5, the voltage variable switch SW11 of the variable resistance unit 100, represented in FIG. 1, is turned off. Accordingly, the voltage of the first connection node N1 between the first resistor R1 and the first diode D11 gradually rises, thereby the first current I1 flowing through the first diode D11 gradually decreases. Simultaneously, the second current I2 flows through the third resistor R13. At this moment, the detection current Id corresponding to a sum current of the first current I1 and the second current I2 gradually decreases to be further lower than the maximum current.

In other words, when the load control signal SLC is the initial driving completion signal of the low level, the variable resistance unit 100 provides variable resistance that sequentially increases for soft frequency changing that gradually decreases the frequency from the high initial driving frequency to the low normal driving frequency. Accordingly, the resistance gradually increases, whereby the current gradually decreases.

Accordingly, when the load control signal SLC is the initial driving completion signal, the current control unit 200 controls generation of a variable current that sequentially decreases from the maximum current Imax in accordance with a variable voltage that is applied to the detection node N2 between the second resistor R12 and the third resistor R13.

Next, in the normal driving interval (interval T3 shown in FIG. 5) illustrated in FIG. 5, when the load control signal SLC is the low-level signal, in the state in which the voltage variable switch SW11 of the variable resistance unit 100, shown in FIG. 1, is turned off, the voltage of the first connection node N1 between the first resistor R1 and the first diode D11 drops. Accordingly, when the first diode D11 is turned off, the first current I1 does not flow through the first diode D11. At this moment, only the second current I2 flows through the third resistor R13. Accordingly, the detection current Id corresponding to the first current I1 becomes the minimum current, and the current control unit 200 controls the generation of the minimum current.

Next, at a start time point of the protection signal (interval T4 shown in FIG. 5) illustrated in FIG. 5, when the load control signal SLC is the high-level signal, the voltage variable switch SW11 of the variable resistance unit 100, shown in FIG. 1, is turned on, whereby the voltage of the first connection node N1 is discharged through the voltage variable switch SW1. Accordingly, the voltage of the first connection node N1 between the first resistor R1 and the first diode D11 gradually decreases. Thereafter, as the first diode D11 is turned on, the current I1 flowing through the first diode d11 gradually increases. Simultaneously, the second current I2 flows through the third resistor R13. At this moment, the detection current Id corresponding to a sum current of the first current I1 and the second current i2 gradually increases from the minimum current to the maximum current.

In other words, when the load control signal SLC is the high level protection signal, the variable resistance unit 100 provides variable resistance that sequentially decreases for soft frequency changing that gradually increases the frequency from a low normal driving frequency to a high protection driving frequency. Accordingly, the resistance of the variable resistance unit 100 decreases, whereby the current flowing through the variable resistance unit 100 increases.

Accordingly, when the load control signal SLC is the protection signal, the current control unit 200 controls the generation of a variable current that sequentially increases from the minimum current Imin in accordance with the variable voltage applied to the detection node N2 between the second resistor R12 and the third resistor R13.

Then, in the protection interval (interval T5 shown in FIG. 5) illustrated in FIG. 5, when the load control signal SLC is maintained to be a high-level signal, in the state in which the voltage variable switch SW11 of the variable resistance unit 100 is turned on, the voltage of the first connection node N1 between the first resistor R1 and the first diode D11 decreases to be the minimum. Accordingly, while the first diode D11 maintains to be in the turned-on state, the first current I1 flowing through the first diode d11 becomes the maximum. Simultaneously, the second current I2 flows through the third resistor R13. At this moment, the detection current Id corresponding to a sum current of the first current I1 and the second current I2 becomes a maximum current, and accordingly, the current control unit 200 controls generation of the maximum current.

As illustrated in FIG. 2, as the resistance of the variable resistance unit 100 changes, the detection current Id flowing through the variable resistance unit 100 changes. The current control unit 200 detects such a current Id in operation S210). In a case where the detection current Id is equal to a maximum reference current Iref-max set in advance, the current control unit 200 controls the generation of a maximum current Imax in operations 5220 and 5230. Alternately, in a case where the detection current Id is lower than the maximum reference current Iref-max set in advance and higher than a minimum current Iref-min set in advance, the current control unit 200 controls the generation of a current in accordance with the magnitude of the detection current Id (in operations 5240 and S250). In addition, in a case where the detection current Id is equal to the minimum current iref-min, the current control unit 200 controls the generation of a minimum current Imin.

The first current source IS1 of the current generating unit 300 variably generates the charging current based on the control of the generation of a variable current that is performed by the current control unit 200. In addition, the second current source IS2 of the current generating unit 300 variably generates the discharging current based on the control of the generation of a variable current that is performed by the current control unit 200.

At this moment, in order to set the discharging time to be shorter than the charging time, the second current source IS2 is configured to generate a current that is higher than that generated by the first current source IS1. As an example of implementation, the second current source IS2 can generate a current that is twice as high as the current generated by the first current source IS1.

As shown in FIG. 3, the current generated by the second current source IS2 is twice as high as the current generated by the first current source IS1. Thus, assuming that a charging time on the basis of the current generated by the first current source IS1 is "T1", a discharging time T2 on the basis of the current generated by the second current source IS2 is a half of the charging time "T1"

$$\left(T2 = \frac{1}{2}T1\right).$$

In the above-described embodiment of the present invention, by adding a first buffering interval between the end time point of the initial driving and the normal driving and adding a second buffering driving interval between the start time point of the protection driving and the protection driving, a peaking phenomenon that occurs in a case where the frequency abruptly changes can be prevented, whereby the internal elements can be protected.

While the present invention has been shown and described in connection with the exemplary embodiments, it will be apparent to those skilled in the art that modifications and variations can be made without departing from the spirit and scope of the invention as defined by the appended claims.

What is claimed is:

1. A reference signal generator, comprising:

a variable resistance unit configured to provide a variable resistance that changes sequentially in accordance with a load control signal acquired by a logical OR operation of an initial driving completion signal and a protection signal for soft frequency changing;

a current control unit configured to control a current flowing through the variable resistance unit and a current flowing through a current generating unit in accordance with the variable resistance provided by the variable resistance unit;

the current generating unit configured to generate a variable current that sequentially changes, based on a control of the current control unit; and a reference signal generating unit configured to control charging of a voltage until a charged voltage charged by the variable current generated by the current generating unit reaches a first reference voltage level, to start discharging of the charged voltage when the charged voltage reaches the first reference voltage level, to control the discharging until the charged voltage reaches a second reference voltage level, and to generate a triangular wave reference signal having a predetermined frequency buffering interval in which a frequency changes sequentially when the initial driving completion signal or the protection signal is input, wherein when the load control signal is the initial driving completion signal of a low level, the variable resistance unit is configured to provide the variable resistance for the soft frequency changing in which a frequency is gradually decreased from a high initial driving frequency to a low normal driving frequency, when the load control signal is the protection signal of a high level, the variable resistance unit is configured to provide the variable resistance for the soft frequency changing in which the frequency is gradually increased from the low normal driving frequency to a high protection driving frequency, and the variable resistance unit comprises:

a first resistor having a first end and a second end, the first end being connected to a first power source voltage terminal;

a first diode having a cathode and an anode, the cathode being connected to the second end of the first resistor;

a second resistor having a first end and a second end, the first end being connected to the anode of the first diode;

a third resistor connected between the second end of the second resistor and a ground;

a fourth resistor having a first end and a second end, the first end being connected to a first connection node between the first resistor and the first diode;

a first capacitor connected between the second end of the fourth resistor and the ground; and a voltage variable switch connected to the first capacitor in parallel, and configured to be turned on when the load control signal is the high level and turned off when the load control signal is the low level.

2. The reference signal generator of claim 1, wherein when the load control signal is the initial driving completion signal, the current control unit is configured to control the generation of the variable current that decreases sequentially in accordance with the variable current flowing through a detection node between the second resistor and the third resistor.

3. The reference signal generator of claim 2, wherein when the load control signal is the protection signal, the current control unit is configured to control the generation of the variable current that increases sequentially in accordance with the variable current flowing through the detection node.

4. The reference signal generator of claim 3, wherein the current generating unit comprises:

a first current source connected to a second power source voltage terminal and configured to generate in a variable manner a charging current based on the control of the generation of the variable current by the variable current control unit; and a second current source connected between the first current source and the ground in series and configured to generate in a variable manner a discharging current based on the control of the generation of the variable current by the current control unit.

5. The reference signal generator of claim 4, wherein the second current source is configured to generate a current that is higher than a current generated by the first current source.

6. The reference signal generator of claim 4, wherein the second current source is configured to generate a current that is twice higher than a current generated by the first current source.

7. The reference signal generator of claim 4, wherein the reference signal generating unit comprises:

a charging capacitor connected between the first current source and the ground and configured to charge the current generated by the first current source;

a charging and discharging switch connected between a connection node between the first current source and the charging capacitor and the second current source, and configured to be turned on or off in accordance with a switching control signal for generating the triangular wave reference signal, turned off for charging the charging capacitor, and turned on for discharging the charging capacitor;

a first comparator configured to compare a charged voltage charged in the charging capacitor by the variable current generated by the current generating unit with the first reference voltage and to output the high level when the charged voltage is higher than the first reference voltage;

a second comparator configured to compare the charged voltage with the second reference voltage and to output the high level when the charged voltage is lower than the second reference voltage; and a latch unit configured to be reset in accordance with the high level output from the first comparator and set in accordance with the high level output from the second comparator, to output a switching control signal for controlling the discharging when being reset, and to output a switching control signal for controlling the charging when being set.

8. A PWM control circuit for LCD backlight, comprising:

a variable resistance unit configured to provide a variable resistance that changes sequentially in accordance with a load control signal acquired by a logical OR operation of an initial driving completion signal and a protection signal for soft frequency changing;

a current control unit configured to control a current flowing through the variable resistance unit and a current flowing through a current generating unit in accordance with the variable resistance provided by the variable resistance unit;

the current generating unit configured to generate a variable current that sequentially changes, based on a control of the current control unit;

a reference signal generating unit configured to control charging of a voltage until a charged voltage charged by the variable current generated by the current generating unit reaches a first reference voltage level, to start discharging of the charged voltage when the charged voltage reaches the first reference voltage level, to control the discharging until the charged voltage reaches a second reference voltage level, and to generate a triangular wave reference signal having a predetermined frequency buffering interval in which a frequency changes sequentially when the initial driving completion signal or the protection signal is input; and a PWM control unit comprising an inverted input terminal configured to receive the reference signal from the reference signal generating unit as an input and two non-inverted input terminals configured to receive an error amplifier voltage and a soft start voltage, the PWM control unit outputting a pulse-width modulated signal by comparing the reference signal, the error amplifier voltage, and the soft start voltage, wherein when the load control signal is the initial driving completion signal of a low level, the variable resistance unit is configured to provide the variable resistance for the soft frequency changing in which a frequency is decreased from a high initial driving frequency to a low normal driving frequency, when the load control signal is the protection signal of a high level, the variable resistance unit is configured to provide the variable resistance for the soft frequency changing in which the frequency is increased from the low normal driving frequency to a high protection driving frequency, and the variable resistance unit comprises:

a first resistor having a first end and a second end, the first end being connected to a first power source voltage terminal;

a first diode having a cathode and an anode, the cathode being connected to the second end of the first resistor;

a second resistor having a first end and a second end, the first end being connected to the anode of the first diode;

a third resistor connected between the second end of the second resistor and a ground;

a fourth resistor having a first end and a second end, the first end being connected to a first connection node between the first resistor and the first diode;

a first capacitor connected between the second end of the fourth resistor and the ground; and a voltage variable switch connected to the first capacitor in parallel, and configured to be turned on when the load control signal is the high level and turned off when the load control signal is the low level.

9. The PWM control circuit for LCD backlight of claim 8, wherein when the load control signal is the initial driving completion signal, the current control unit is configured to control the generation of the variable current that sequentially decreases in accordance with the variable current flowing through a detection node between the second resistor and the third resistor.

10. The PWM control circuit for LCD backlight of claim 9, wherein when the load control signal is the protection signal, the current control unit is configured to control the generation of the variable current that sequentially increases in accordance with the variable current flowing through the detection node.

11. The PWM control circuit for LCD backlight of claim 10, wherein the current generating unit comprises:

a first current source connected to a second power source voltage terminal and configured to generate in a variable manner a charging current based on the control of the variable current generation that is performed by the current control unit; and a second current source connected between the first current source and the ground in series and configured to generate in a variable manner a discharging current based on the control of the generation of the variable current by the current control unit.

12. The PWM control circuit for LCD backlight of claim 11, wherein the second current source is configured to generate a current that is higher than a current generated by the first current source.

13. The PWM control circuit for LCD backlight of claim 11, wherein the second current source is configured to generate a current that is twice higher than a current generated by the first current source.

14. The PWM control circuit for LCD backlight of claim 11, wherein the reference signal generating unit comprises:

a charging capacitor connected between the first current source and the ground and configured to charge the current generated by the first current source;

a charging and discharging switch connected between a connection node between the first current source and the charging capacitor and the second current source, and configured to be turned on or off in accordance with a switching control signal for generating the reference signal of a triangular wave, turned off for charging the charging capacitor, and turned on for discharging the charging capacitor;

a first comparator configured to compare a charged voltage charged in the charging capacitor by the variable current generated by the current generating unit with the first reference voltage and to output the high level when the charged voltage is higher than the first reference voltage;

a second comparator configured to compare the charged voltage with the second reference voltage and to output the high level when the charged voltage is lower than the second reference voltage; and a latch unit configured to be reset in accordance with the high level output from the first comparator and set in accordance with the high level output from the second comparator, outputting a switching control signal controlling the discharging when being reset, and to output a switching control signal for controlling the charging control when being set.

* * * * *